US010625296B1

(12) United States Patent
Velez

(10) Patent No.: US 10,625,296 B1
(45) Date of Patent: Apr. 21, 2020

(54) PAINT DISPENSING ROLLER ASSEMBLY

(71) Applicant: Gustavo A. Velez, Aventura, FL (US)

(72) Inventor: Gustavo A. Velez, Aventura, FL (US)

( * ) Notice: Subject to any disclaimer, the term of this patent is extended or adjusted under 35 U.S.C. 154(b) by 0 days.

(21) Appl. No.: 16/724,090

(22) Filed: Dec. 20, 2019

Related U.S. Application Data

(63) Continuation of application No. PCT/US2019/022150, filed on Mar. 13, 2019.

(51) Int. Cl.
*B05C 17/025* (2006.01)
*B05C 17/02* (2006.01)
*B05C 17/03* (2006.01)

(52) U.S. Cl.
CPC ..... *B05C 17/025* (2013.01); *B05C 17/0217* (2013.01); *B05C 17/0245* (2013.01); *B05C 17/0308* (2013.01)

(58) Field of Classification Search
CPC ... B05C 17/025; B05C 17/0217; B05C 17/02; B05C 17/0207; B05C 17/0222; B05C 17/0242; B05C 17/0245; B05C 17/0308
USPC ..... 401/208, 219, 220, 4
See application file for complete search history.

(56) References Cited

U.S. PATENT DOCUMENTS 2,563,049 A 8/1951 Liebelt et al.
2,708,763 A 5/1955 Jacoby
2,849,157 A 8/1958 Remien, Jr.
3,825,970 A 7/1974 Hanssen
4,237,592 A 12/1980 Kuge et al.
4,268,943 A 5/1981 Watanabe et al.
4,555,195 A 11/1985 deVreeze et al.
4,735,522 A 4/1988 Myun-Sik
4,765,353 A 8/1988 Rhoades
4,903,843 A 2/1990 Fischer
5,419,003 A 5/1995 Tollasepp
5,564,851 A 10/1996 Connelly et al.
5,795,279 A * 8/1998 Shieh ..... B05C 17/025 15/230.11
6,036,392 A 3/2000 Er
(Continued)

FOREIGN PATENT DOCUMENTS

WO 2009077812 A2 6/2009

*Primary Examiner* — David J Walczak
(74) *Attorney, Agent, or Firm* — Mark C. Johnson; Johnson |Dalal

(57) ABSTRACT

A paint dispensing roller assembly that comprises an applicator member of an absorbent material defining an enclosed applicator member cavity. The assembly further comprises a paint dispensing member disposed at least partially within the enclosed applicator member cavity and having an outer undulating surface with an alternating plurality of ridges and valleys defining an enclosed paint mixing cavity having at least one enclosed aperture defined thereon. The paint dispensing roller assembly also includes a cantilevered mixing member disposed at least partially within the enclosed paint mixing cavity and having at least one flange projecting radially from the cantilevered mixing member. The paint dispensing roller assembly further comprises a roller body including a handle and a shell portion defining a shell cavity wherein the applicator member is partially disposed. The applicator member and paint dispensing member are operably configured to rotate 360 degrees with respect to the roller body.

16 Claims, 12 Drawing Sheets

(56) References Cited

U.S. PATENT DOCUMENTS

| | | | | |
|---|---|---|---|---|
| 6,099,186 | A * | 8/2000 | Lye | B05C 17/0308 401/197 |
| 6,877,925 | B2 * | 4/2005 | Fernandez | B05C 17/02 401/197 |
| 8,821,058 | B2 | 9/2014 | Walker et al. | |
| 2005/0050666 | A1 * | 3/2005 | Schumm | A47L 13/14 15/230.11 |
| 2007/0048068 | A1 * | 3/2007 | Bullivant | A46B 11/0013 401/220 |
| 2012/0163899 | A1 * | 6/2012 | Wang | A46B 11/06 401/148 |

* cited by examiner

PAINT DISPENSING ROLLER ASSEMBLY

CROSS-REFERENCE TO RELATED APPLICATION

This application is a continuation of International Application Number PCT/US19/22150, filed Mar. 13, 2019, the entirety of which of which is incorporated herein by reference.

FIELD OF THE INVENTION

The present invention relates generally to paint rollers, and, more particularly, relates to paint rollers equipped with paint.

BACKGROUND OF THE INVENTION

Typically, paint rollers are used to paint large surface areas because of their ability to cover these larger areas in a shorter amount of time as opposed to, for example, paint brushes. Further, due to their rolling, foam-like surfaces, paint rollers are able to effortlessly disperse paint on surfaces in even distributions. Therefore, paint rollers are well known.

Moreover, paint rollers which have the capability of being loaded with paint prior to use are also known. These devices allow a user to freely paint a surface without requiring the user to constantly dip the device into more paint in order to completely cover the surface. However, as those of skill in the art may appreciate, paint needs to be mixed after sitting for a period of time in order to maintain its consistency. As such, there are several drawbacks to these devices, for example, these devices do not incorporate embedded mixers.

Additionally, the known paint rollers which have the capability of being loaded with paint prior to use do not incorporate a paint assembly packaging which encloses the paint roller in an airtight configuration maintaining the original liquefied consistency of the paint mixture loaded within the paint roller.

Finally, the prior art incorporates a multitude of different components, thereby making the paint rollers more expensive and complicated to assemble.

Therefore, a need exists to overcome the problems with the prior art as discussed above.

SUMMARY OF THE INVENTION

The invention provides a paint dispensing roller assembly that overcomes the hereinafore-mentioned disadvantages of the heretofore-known devices and methods of this general type and that effectively incorporates a paint mixing cavity capable of holding a paint mixture and also includes an embedded mixing member that efficiently mixes the paint mixture during use.

With the foregoing and other objects in view, there is provided, in accordance with the invention, a paint dispensing roller assembly comprising an applicator member of a cylindrical shape and an absorbent material. The applicator member includes two opposing ends, an applicator length separating the ends, an outer application surface surrounding the cylindrical shape and spanning the applicator length. The applicator member defines an enclosed applicator member cavity spanning the applicator length. The paint dispensing roller assembly also includes a paint dispensing member of a cylindrical shape disposed, at least partially, within the enclosed applicator member cavity. The paint dispensing member has a first end, a second end opposing the first end, and a dispensing member length separating the first and second ends. The paint dispensing member also includes an outer undulating surface spanning along the dispensing member length with a plurality of ridges and a plurality of valleys disposed in an alternating configuration with one another, and defining an enclosed paint mixing cavity. Further, a plurality of at least one of the plurality of ridges and the plurality of valleys respectively have at least one enclosed aperture defined thereon. The paint dispensing roller assembly also includes a cantilevered mixing member disposed, at least partially, within the enclosed paint mixing cavity. The cantilevered mixing member includes a first end, a second end opposing the first end, and a mixing member length separating the first and second ends of the cantilevered mixing member. The cantilevered mixing member also includes at least one flange projecting radially from the cantilevered mixing member along the mixing member length and encapsulated in the paint mixing cavity. The paint dispensing roller assembly also includes a roller body including a handle with a surface configured for grasping by a user and a shell portion having a shell inner surface defining a shell cavity. The shell cavity having the cylindrical shape of the applicator member partially disposed therein. Further, the applicator member and the paint dispensing member are operably configured to rotate 360 degrees with respect to the roller body.

In some embodiments, the shell cavity is of a concave shape and shaped and sized to partially receive the cylindrical shape of the applicator member along the applicator length.

In some embodiments, the second end of the cantilevered mixing member is free and the first end of the cantilevered mixing member is directly coupled to the shell inner surface through a male-female coupling configuration.

In accordance with a further feature, the shell inner surface further comprises a first side, a second side opposing the first side, wherein the first side of the shell inner surface is directly coupled to the first end of the cantilevered mixing member through the male-female coupling configuration and the second side of the shell inner surface is directly coupled to the second end of the paint dispensing member through a male-female coupling configuration.

In some embodiments, the paint dispensing member comprises an inner surface defining the enclosed paint mixing cavity. The enclosed paint mixing cavity includes an inner side surface disposed proximal (e.g., near or approximately within 5-10% of the dispensing member length) to the second end of the paint dispensing member and includes a portion shaped and sized to receive and partially enclose the second end of the cantilevered mixing member.

In accordance with an additional feature of the present invention, the portion on the inner side surface of the inner surface of the paint dispensing member is shaped and sized to frictionally retain the second end of the cantilevered mixing member. Further, the second end of the cantilevered mixing member is selectively removably coupled to the portion on the inner side surface of the inner surface of the paint dispensing member.

In some embodiments, the first end of the paint dispensing member defines an enclosed first end opening that is operably configured to selectively removably couple to the first end of the cantilevered mixing member through a threaded coupling configuration.

In some embodiments, the outer undulating surface spans substantially (e.g., equal to or greater than 90%) the dispensing member length and surrounds the cylindrical shape of the paint dispensing member.

In some embodiments, the cantilevered mixing member further comprises two flanges projecting radially in opposing directions from the cantilevered mixing member along the mixing member length.

In accordance with an additional feature, the two flanges are of a plate-like shape and substantially rigid material, each having at least one enclosed aperture defined thereon.

In some embodiments, the plurality of ridges and the plurality of valleys are uniformly spaced spanning the dispensing member length.

In additional embodiments, at least approximately 40% of either the plurality of ridges or the plurality of valleys include at least one enclosed aperture defined thereon along the dispensing member length.

In some embodiments, at least two of either the plurality of ridges or the plurality of valleys, respectively, have at least two enclosed apertures defined and disposed at equally distant configurations around a circumference thereon.

In some embodiments, the paint dispensing roller assembly further comprises a paint assembly packaging, of a polymeric material, spanning the dispensing member length and substantially enclosing, in a hermetically sealed configuration, the applicator member and the paint dispensing member, wherein the enclosed paint mixing cavity houses paint mixture therein.

In accordance with yet another feature, the paint assembly packaging further comprises a first end, a second end opposing the first end, an outer surface, and an inner surface. The paint assembly packaging also comprises a tab projecting outwardly away from either the first end or the second end of the paint assembly packaging and coupled to a plurality of readily severable indentations disposed on the outer surface of the paint assembly packaging, substantially spanning the dispensing member length.

In other embodiments, the paint dispensing roller assembly comprising an applicator member of a cylindrical shape and an absorbent material. The applicator member includes two opposing ends, an applicator length separating the ends, an outer application surface surrounding the cylindrical shape and spanning the applicator length. The applicator member defines an enclosed applicator member cavity spanning the applicator length. The paint dispensing roller assembly also includes a paint dispensing member of a cylindrical shape disposed, at least partially, within the enclosed applicator member cavity. The paint dispensing member has a first end, a second end opposing the first end, and a dispensing member length separating the first and second ends. The paint dispensing member also defines an enclosed paint mixing cavity with a plurality of enclosed apertures defined thereon. The paint dispensing roller assembly also includes a cantilevered mixing member disposed, at least partially, within the enclosed paint mixing cavity. The cantilevered mixing member includes a first end, a second end opposing the first end, and a mixing member length separating the first and second ends of the cantilevered mixing member. The cantilevered mixing member also includes at least one flange projecting radially from the cantilevered mixing member along the mixing member length and encapsulated in the paint mixing cavity. The paint dispensing roller assembly also includes a roller body including a handle with a surface configured for grasping by a user and a shell portion having a shell inner surface defining a shell cavity. The shell cavity having the cylindrical shape of the applicator member partially disposed therein.

Further, the applicator member and the paint dispensing member are operably configured to rotate 360 degrees with respect to the roller body. The paint dispensing roller assembly also includes a paint assembly packaging, of a polymeric material, spanning the dispensing member length and substantially enclosing, in a hermetically sealed configuration, the applicator member and the paint dispensing member, wherein the enclosed paint mixing cavity houses paint mixture therein.

In accordance with another feature, the paint dispensing member further comprises an outer undulating surface spanning along the dispensing member length with a plurality of ridges and a plurality of valleys disposed in an alternating configuration with one another, wherein the plurality of enclosed apertures are defined on at least one of the plurality of ridges and the plurality of valleys.

In some embodiments, the paint assembly packaging further comprises a first end, a second end opposing the first end, an outer surface, and an inner surface. The paint assembly packaging also includes a tab projecting outwardly away from either the first end or the second end of the paint assembly packaging and coupled to a plurality of readily severable indentations disposed on the outer surface of the paint assembly packaging and substantially spanning the dispensing member length.

One objective of the present invention is to provide a paint roller equipped with a paint mixture embedded within the roller that effectively allows a user to paint a surface without having to continuously dip the roller into more of the paint mixture.

Another objective of the present invention is to provide a paint roller with a paint dispensing member disposed within that features an undulating surface having apertures that are designed to control the output of the paint mixture embedded within the paint dispensing member.

Another objective of the present invention is to provide a paint roller that contains an embedded mixer member within the roller operably configured to mix the paint mixture and keep its original consistency while the roller is being used.

Another objective of the present invention is to evenly disperse the paint mixture on a surface.

Another objective is to provide airtight packaging that seals the paint mixture and keeps it in its original liquefied composition.

Another objective is to provide a paint roller equipped with a paint mixing cavity disposed within that has the capability of holding a paint mixture, wherein the paint mixing cavity may be accessed and refilled so that the paint roller can be easily reused by consumers infinitely.

Although the invention is illustrated and described herein as embodied in a paint dispensing roller assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one.

The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of each of the applicator member, paint dispensing member, and cantilevered mixing member of the assembly. Further, in this document, the term "vertical" should be understood to mean in a direction directly opposite of the longitudinal direction.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
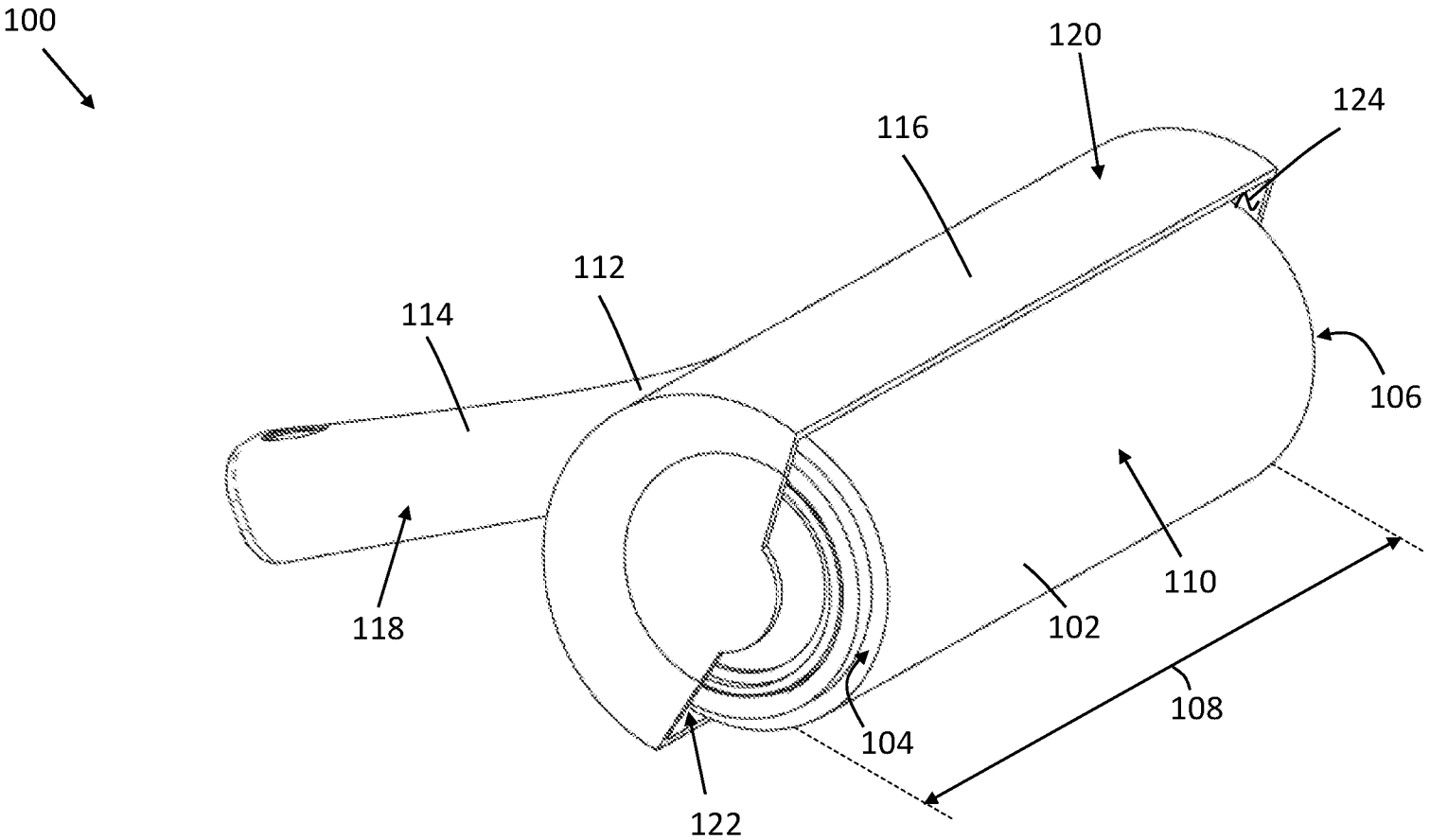
FIG. 1 is a perspective view of a paint dispensing roller assembly according to one embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms. Therefore, specific structural and functional details disclosed herein are not to be interpreted as limiting, but merely as a basis for future claims and as a representative basis for teaching one of ordinary skill in the art to variously employ the present invention in virtually any appropriately detailed structure. Further, the terms and phrases used herein are not intended to be limiting; but rather, to provide an understandable description of the invention. It is believed that the invention will be better understood from a consideration of the following description in conjunction with the drawing figures, in which like reference numerals are carried forward. The figures of the drawings are not drawn to scale.

The present invention provides a novel and efficient paint dispensing roller assembly which offers an embedded mixing member to mix the paint during use. More specifically, embodiments of the invention provide a paint dispensing roller assembly composed of an applicator member of a cylindrical shape, an absorbent material, and defining an enclosed applicator member cavity. This applicator member may be replaceable by users in some embodiments or may be disposable with other components of the assembly. In addition, the assembly includes a paint dispensing member disposed at least partially within the enclosed applicator member cavity and having an outer undulating surface including a plurality of ridges and a plurality of valleys, wherein a plurality of either a plurality of ridges or a plurality of valleys on the outer undulating surface have at least one enclosed aperture defined thereon for release of paint housed within an enclosed paint mixing cavity defined by the paint dispensing member. Further, the assembly includes a cantilevered mixing member disposed at least partially within the paint mixing cavity having at least one flange projecting radially from the cantilevered mixing member and encapsulated within the paint mixing cavity. In addition, the assembly includes a roller body having a handle and a shell portion defining a shell cavity having the applicator member partially disposed therein, wherein the applicator member and the paint dispensing member are operably configured to rotate 360 degrees with respect to the roller body.

Figure 9:
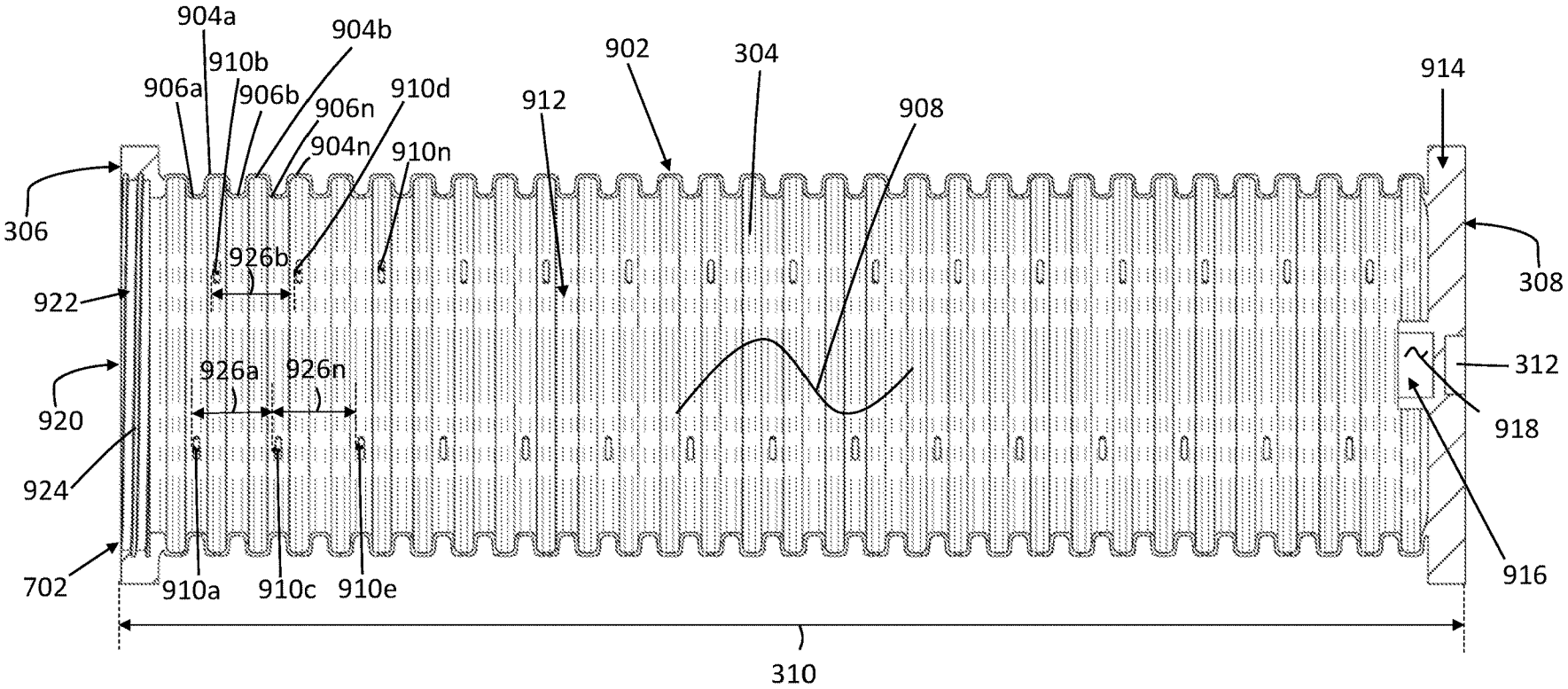
FIG. 9 is a cross-sectional view of the paint dispensing member in FIG. 3 taken along section line B-B of FIG. 8.
Figure 11:
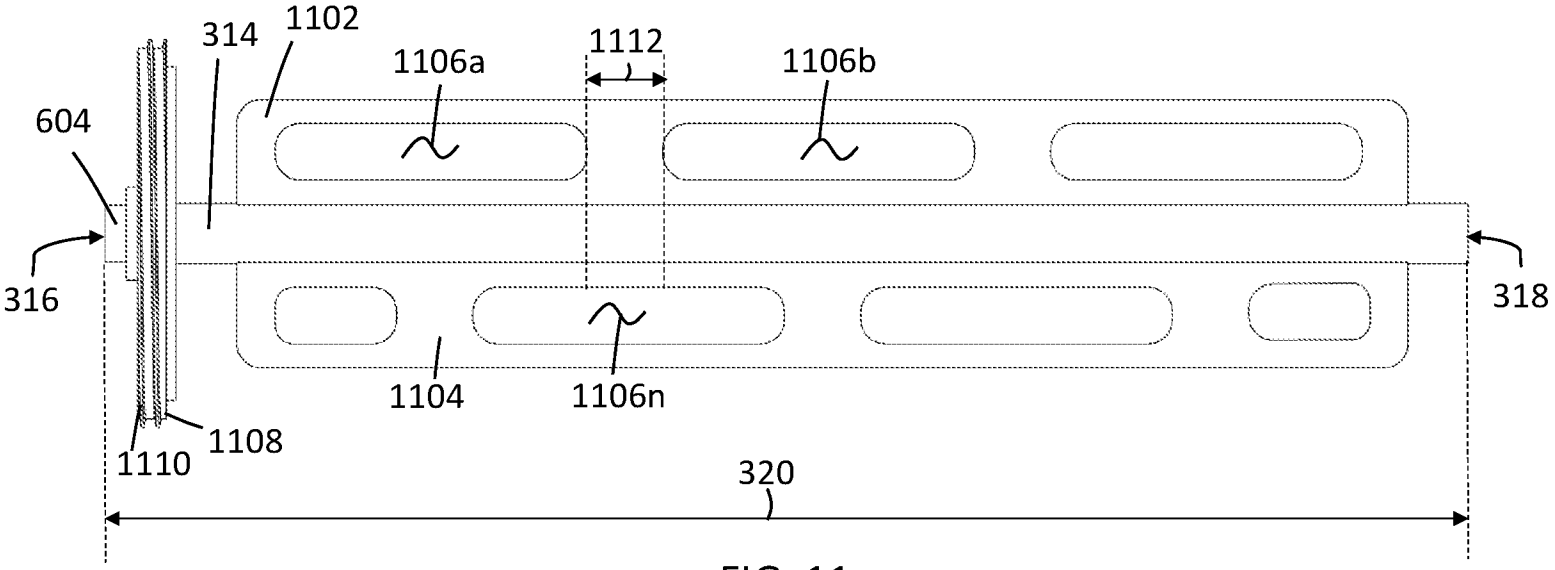
FIG. 11 is a side view of the cantilevered mixing member in FIG. 3 in accordance with one embodiment of the present invention.

Referring now to FIGS. 1-4, one embodiment of the present invention is shown in perspective, top plan, and exploded views, respectively. FIG. 1, along with other figures, shows several advantageous features of the present invention, but, as will be described below, the invention can be provided in several shapes, sizes, combinations of features and components, and varying numbers and functions of the components. The first example of a paint dispensing roller assembly 100, as shown best in FIGS. 1-4, includes an applicator member 102 of a cylindrical shape and an absorbent material. The applicator member 102 includes a first end 104, a second end 106 opposing the first end 104, and an applicator length 108 separating the first and second ends 104, 106. The applicator member 102 further includes an outer application surface 110 surrounding the cylindrical shape of the applicator member 102 and spanning the applicator length 108. The applicator member 102 defines an enclosed applicator member cavity 302 spanning the applicator length 108. The assembly 100 further includes a paint dispensing member 304 of a cylindrical shape and disposed at least partially within the enclosed applicator member cavity 302. The paint dispensing member 304 includes a first end 306, a second end 308 opposing the first end 306, and a dispensing member length 310 separating the first and second ends 306, 308. As shown in FIG. 9, the paint dispensing member 304 further includes an outer undulating surface 902 spanning along the dispensing member length 310 with a plurality of ridges 904*a-n*, where "n" represents any number greater than one, and a plurality of valleys 906*a-n*, where "n" represents any number greater than one. The plurality of ridges and valleys 904*a-n*, 906*a-n* are disposed in an alternating configuration with one another, defining an enclosed paint mixing cavity 908, wherein a plurality of at least one of the plurality of ridges and valleys 904*a-n*, 906*a-n*, respectively have at least one enclosed aperture 910*a-n*, where "n" represents any number greater than one, defined thereon. The paint dispensing roller assembly 100 further includes a cantilevered mixing member 314 disposed at least partially within the enclosed paint mixing cavity 908. The cantilevered mixing member 314 includes a first end 316, a second end 318 opposing the first end 316, and a mixing member length 320 separating the first and second ends 316, 318. The cantilevered mixing member 314 further includes at least one flange 1102 (as best shown in FIG. 11) projecting radially along the mixing member length 320 and encapsulated in the paint mixing cavity 908. The assembly 100 also includes a roller body 112 including a handle 114 and a shell portion 116. The handle 114 includes a surface 118 configured for grasping by a user. The shell portion 116 includes a shell outer surface 120 and a shell inner surface 122 opposing the shell outer surface 120. The shell inner surface 122 defines a shell cavity 124 with the cylindrical shape of the applicator member 102 partially disposed therein. The applicator member 102 and paint dispensing member 304 are operably configured to rotate 360 degrees with respect to the roller body 112.

In a further embodiment, the shell cavity 124 is of a concave shape that is shaped and sized to partially receive the cylindrical shape of the applicator member 102 along the applicator length 108.

In some embodiments, the second end 318 of the cantilevered mixing member 314 is free. Further, as best shown in FIG. 6, the first end 316 of the cantilevered mixing member 314 is directly coupled to the shell inner surface 122 through a male-female coupling configuration 602.

Figure 3:
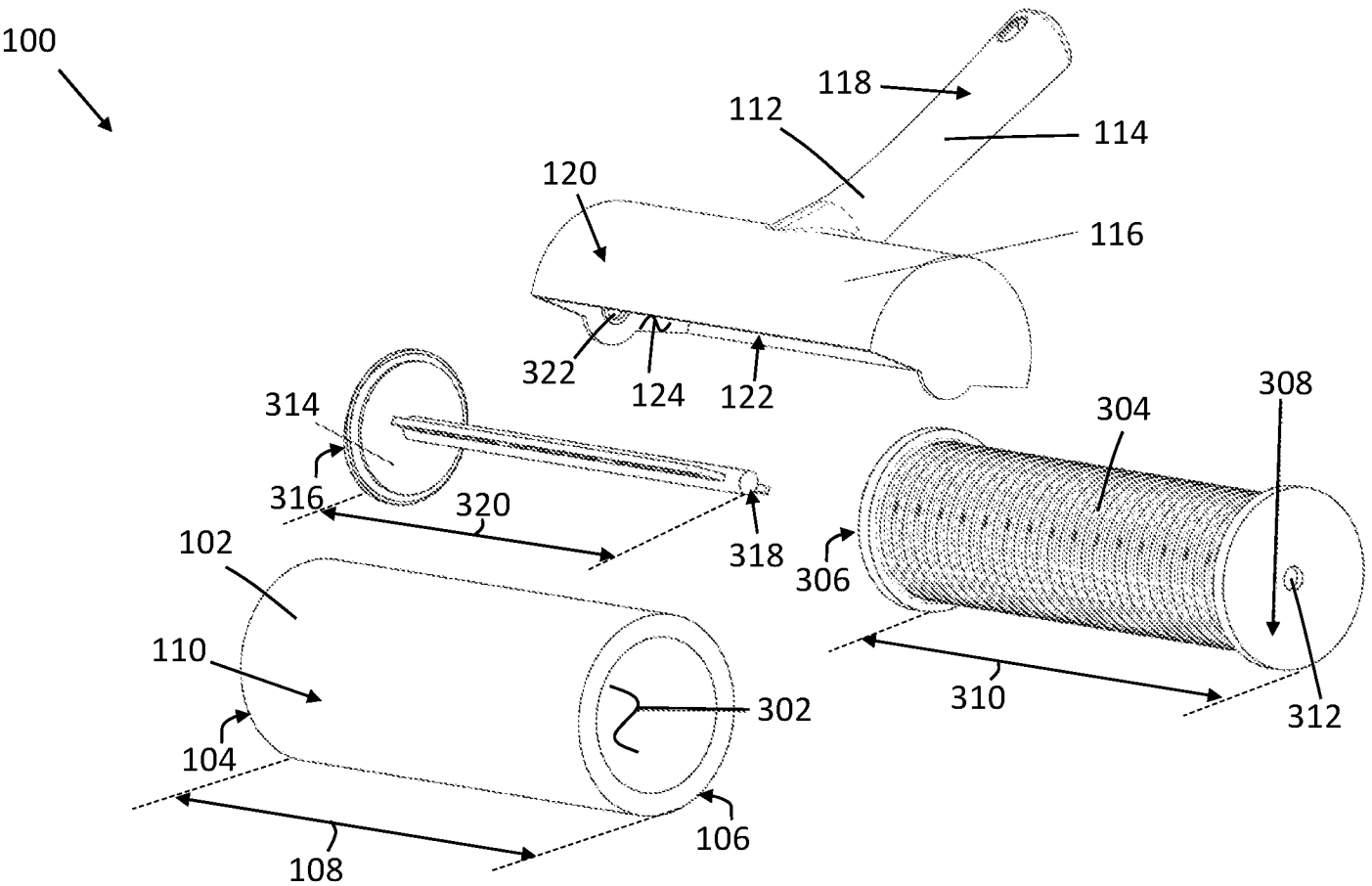
FIG. 3 is an exploded view of a paint dispensing roller assembly in accordance with one embodiment of the present invention.
Figure 4:
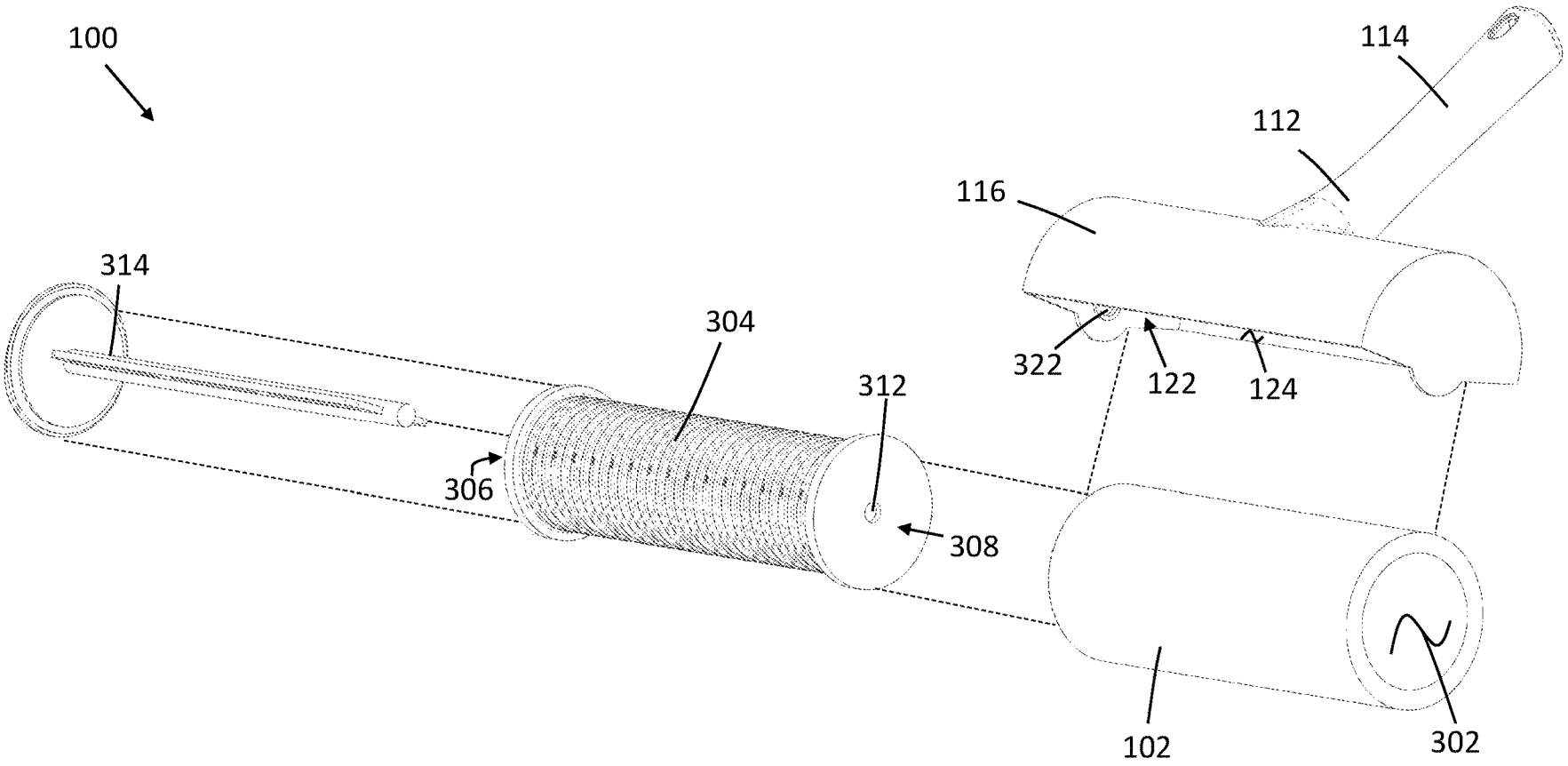
FIG. 4 is another exploded view of a paint dispensing roller assembly in accordance with one embodiment of the present invention.
Figure 12:
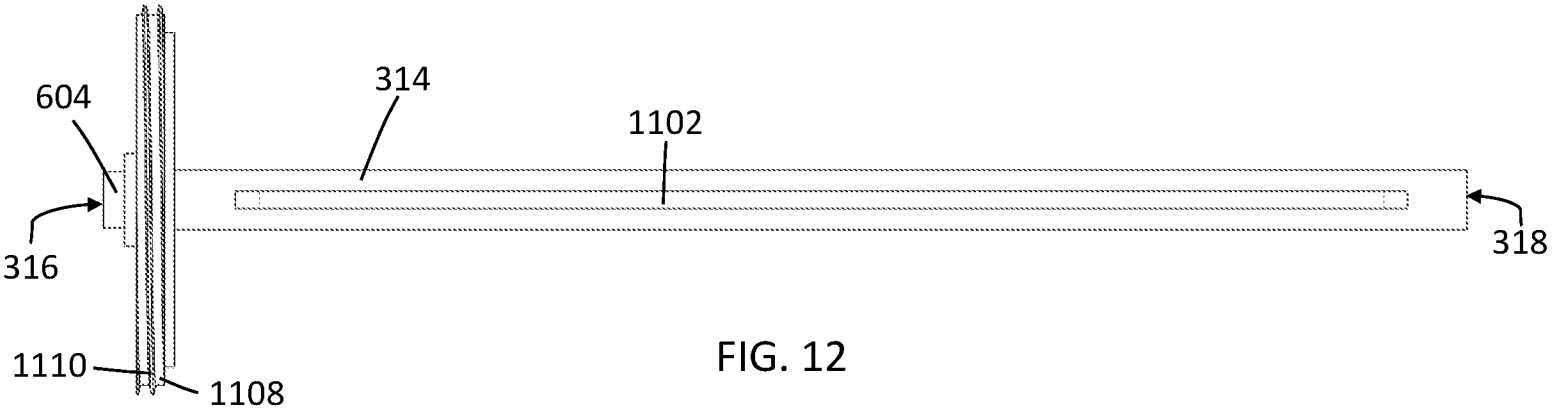
FIG. 12 is a top plan view of the cantilevered mixing member in FIG. 11.

In preferred embodiments, the male-female coupling configuration 602 includes a female connector 322 and a male connector 604 wherein, as shown in FIGS. 3-4, the female connector 322 is disposed on the shell inner surface 122 of the shell portion 116 of the roller body 112, and, as shown in FIGS. 11-12, the male connector 604 is disposed on the first end 316 of the cantilevered mixing member 314. However, in other embodiments not shown, the female connector 322 may be disposed on the cantilevered mixing member 314 and the male connector 604 may be disposed on the shell inner surface 122 of the shell portion 116 of the roller body 112.

Figure 6:
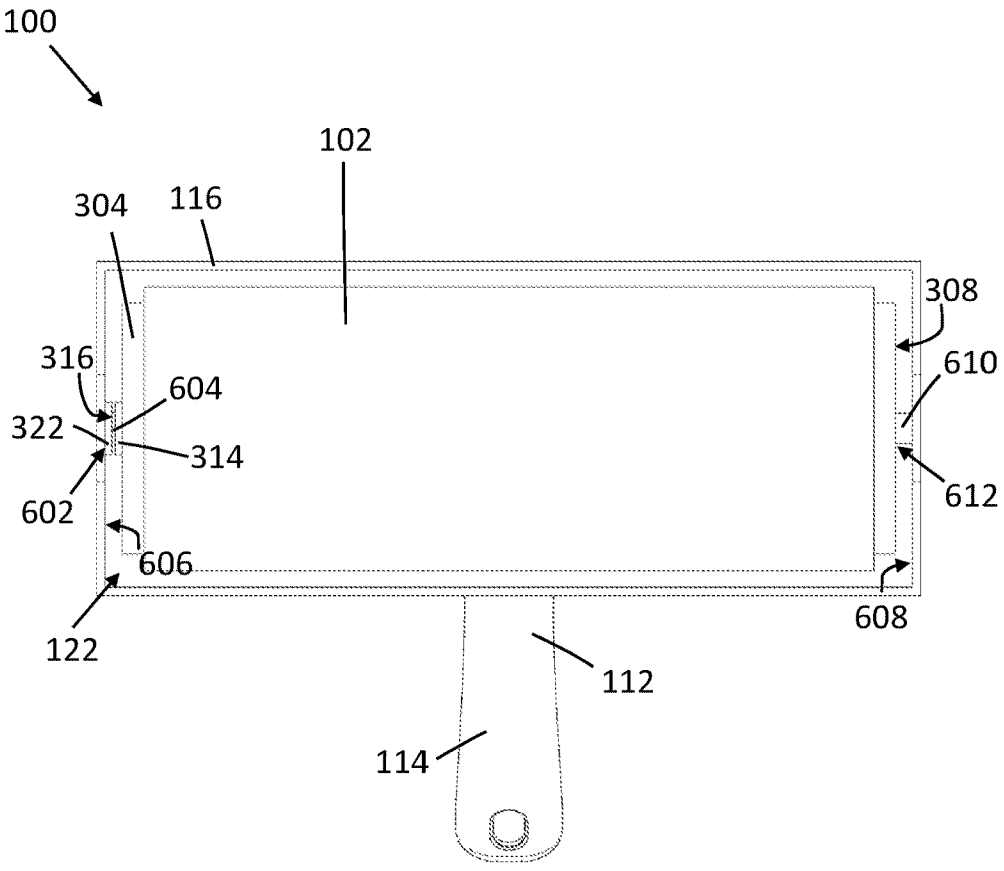
FIG. 6 is a cross-sectional view of a paint dispensing roller assembly taken along section line A-A of FIG. 5, in accordance with one embodiment of the present invention.
Figure 5:
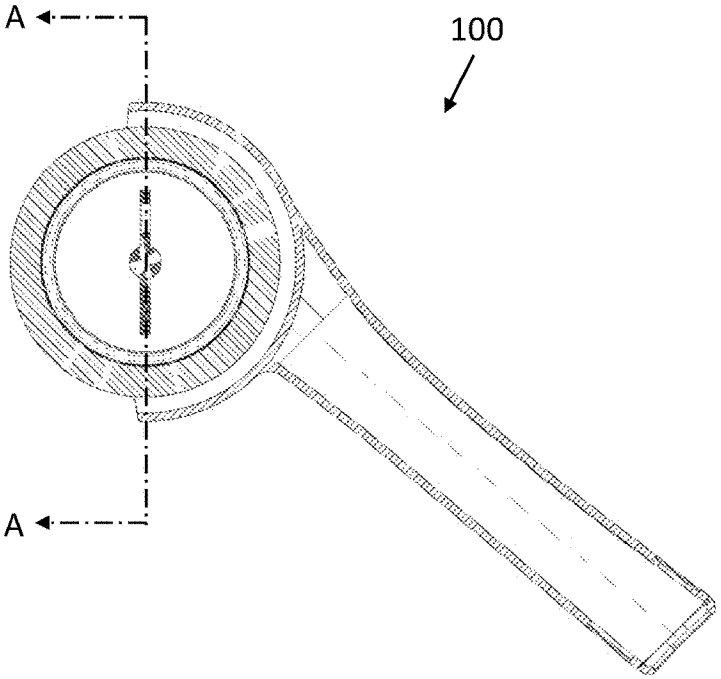
FIG. 5 is a side view of a paint dispensing roller assembly in accordance with one embodiment of the present invention.

Referring now to FIG. 6, the shell inner surface 122 further comprises a first side 606 and a second side 608 opposing the first side 606, wherein the first side 606 is directly coupled to the first end 316 of the cantilevered mixing member 314 through the male-female coupling configuration 602 and the second side 608 of the shell inner surface 122 is directly coupled to the second end 308 of the paint dispensing member 304 through a male-female coupling configuration 612. It is important to note, however, that the male-female coupling configurations 602, 612 do not restrict the independent movement (i.e., the capability to rotate 360 degrees) of the applicator member 102 and paint dispensing member 304 with respect to the roller body 112.

Referring now to FIG. 3, the second end 308 of the paint dispensing member 304 includes a female connector 312. Additionally, as seen in FIG. 6, the second side 608 of the shell inner surface 122 may include a male connector 610 operably configured to couple to the female connector 312 disposed on the second end 308 of the paint dispensing member 304. Thus, the male-female coupling configuration 612 connecting the shell inner surface 122 to the paint dispensing member 304 includes the female connector 312 and the male connector 610. However, in other embodiments not shown, the female connector 312 may be disposed on the second side 608 of the shell inner surface 122 and the male connector 610 may be disposed on the second end 308 of the paint dispensing member 304.

In a further embodiment, best seen in FIG. 9, the paint dispensing member 304 comprises an inner surface 912 defining the enclosed paint mixing cavity 908. The inner surface 912 includes an inner side surface 914 disposed proximal to (e.g., between approximately 5-10% of the dispensing member length 310) the second end 308 of the paint dispensing member 304. The inner side surface 914 includes a portion 916 defining a recess 918 shaped and sized to receive and partially enclose the second end 318 of the cantilevered mixing member 314 (not shown).

In a further embodiment, the recess 918 of the portion 916 on the inner side surface 914 of the inner surface 912 of the paint dispensing member 304 is shaped and sized to frictionally retain the second end 318 of the cantilevered mixing member 314. Moreover, the second end 318 of the cantilevered mixing member 314 is selectively removably coupled to the recess 918 of the portion 916 on the inner side surface 914 of the inner surface 912 of the paint dispensing member 304.

In some embodiments, the recess 918 of the portion 916 may be substantially centrally disposed on the inner side surface 914 of the paint dispensing member 304 to allow for the cantilevered mixing member 314 and the at least one radially projecting flange 1102 to at least partially sit within the paint dispensing member 304.

Figure 13:
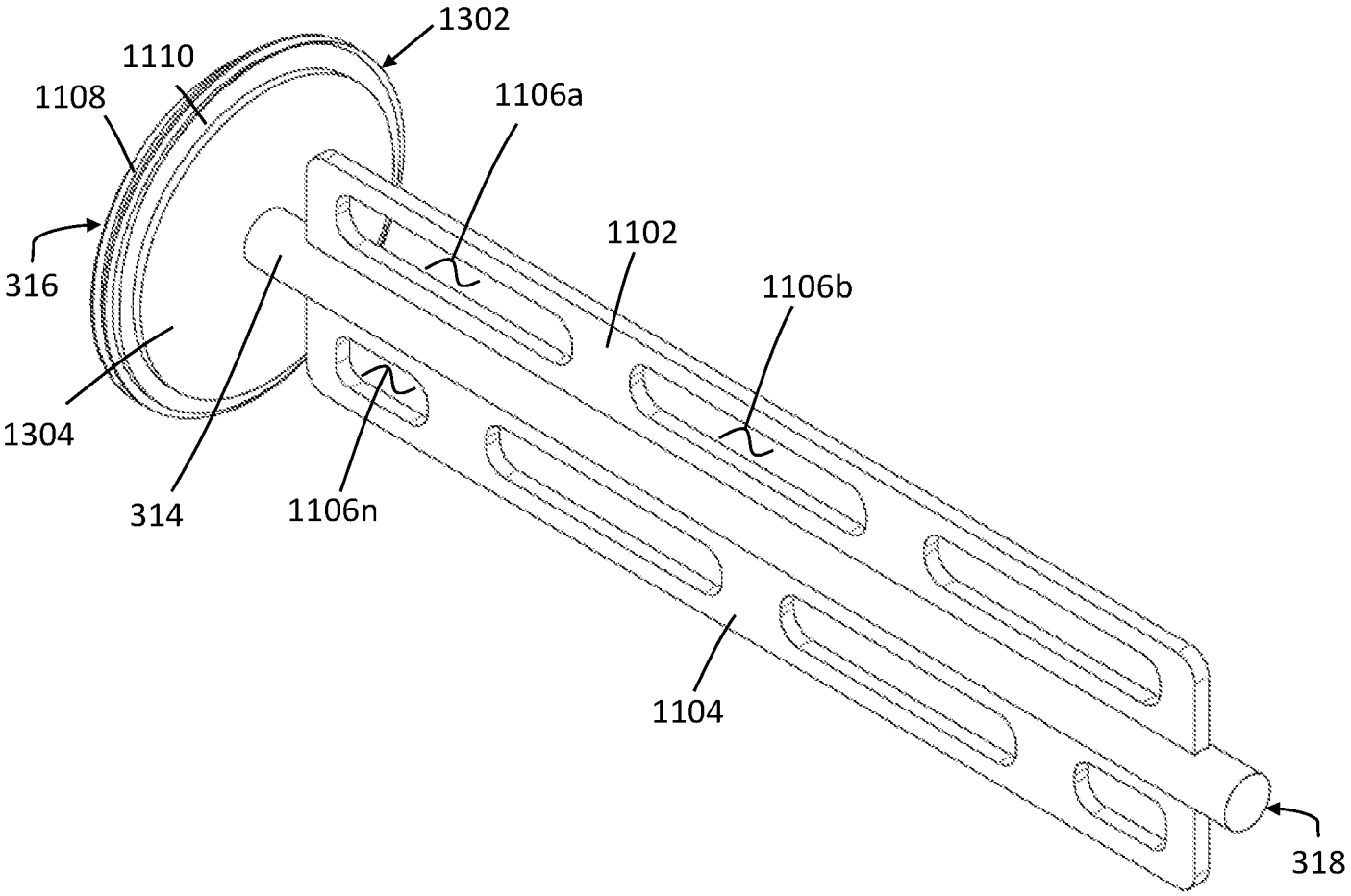
FIG. 13 is a perspective view of the cantilevered mixing member in FIG. 11.

In some embodiments, as shown in FIGS. 11-13, the first end 316 of the cantilevered mixing member 314 includes a closure member 1108 having a circumference 1302 and an external thread 1110 substantially spanning the circumference 1302 of the closure member 1108.

Figure 7:
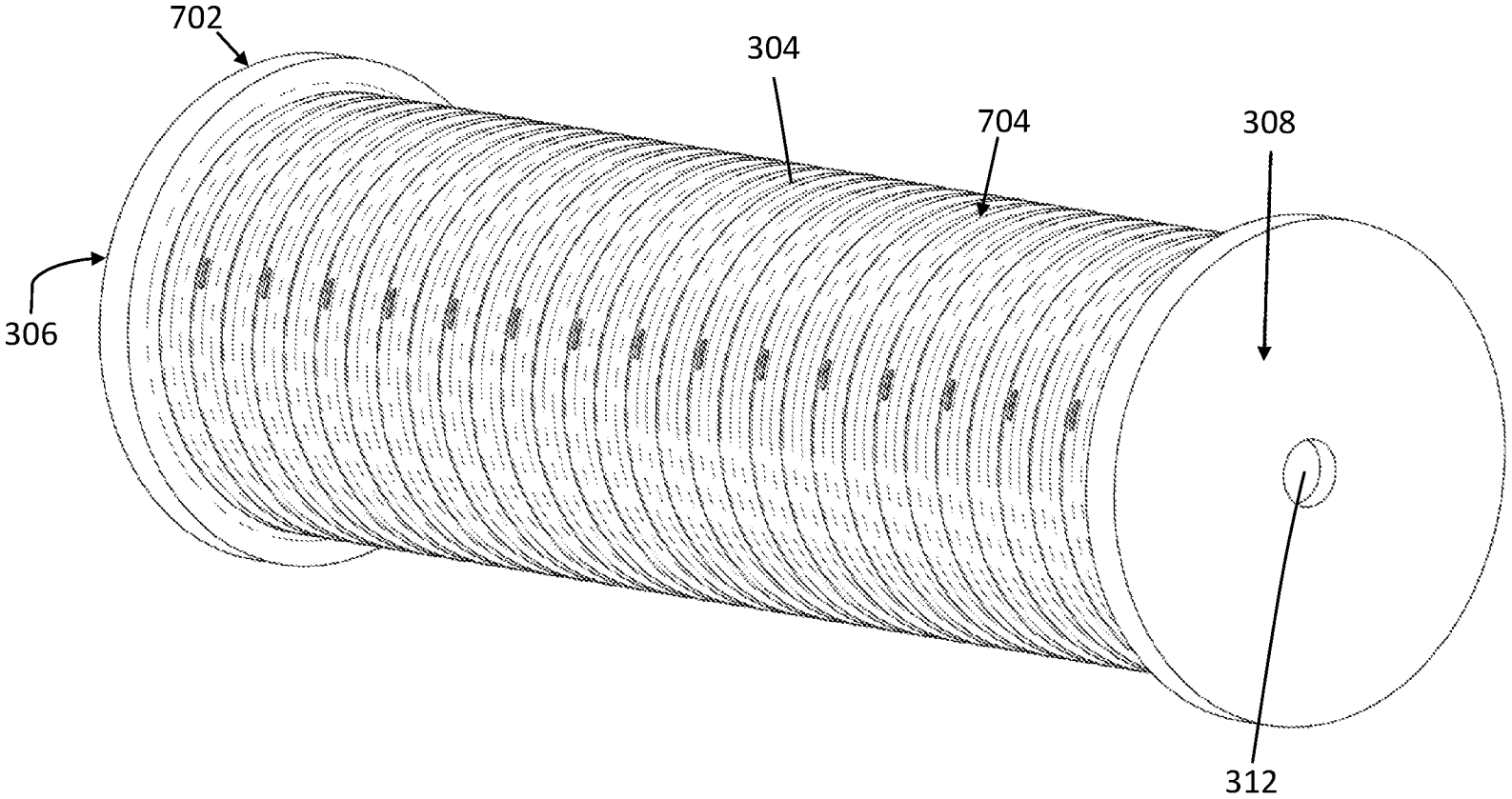
FIG. 7 is a perspective view of the paint dispensing member in FIG. 3.
Figure 8:
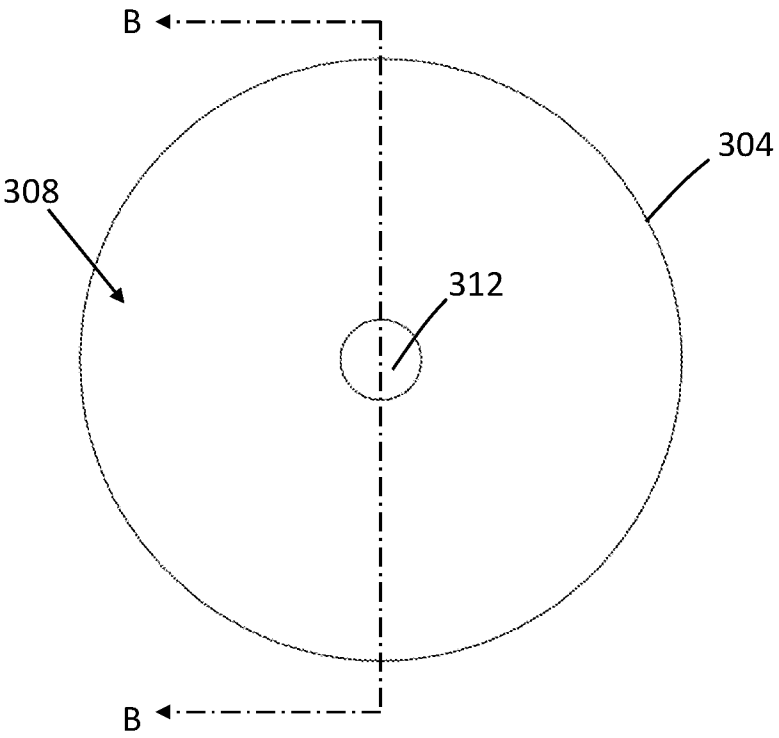
FIG. 8 is a side view of the paint dispensing member in FIG. 3.

Referring back to FIG. 9, in some embodiments, the first end 306 of the paint dispensing member 304 defines an enclosed first end opening 920 and is operably configured to selectively removably couple to the first end 316 of the cantilevered mixing member 314 through a threaded coupling configuration (not shown). The enclosed first end opening 920 includes a circumference 702 (shown best in FIG. 7) and a neck finish portion 922. The neck finish portion 922 includes an internal thread 924 substantially spanning the circumference 702 of the neck finish portion 922.

When the external thread 1110 of the closure member 1108 of the cantilevered mixing member 314 and the internal thread 924 of the neck finish portion 922 of the enclosed first end opening 920 of the paint dispensing member 304 combine, they dispose the cantilevered mixing member 314 and the paint dispensing member 304 in the threaded coupling configuration (not shown). Said another way, the first end 316 of the cantilevered mixing member 314 is operably configured to screw onto the paint dispensing member 304 and selectively removably retain the cantilevered mixing member 314. However, in other embodiments, the first end 306 of the paint dispensing member 304 may selectively removably couple to the first end 316 of the cantilevered mixing member 314 through any other coupling configuration which is sufficient to selectively removably retain the cantilevered mixing member 314 within the enclosed paint mixing cavity 908 of the paint dispensing member 304.

In some embodiments, the outer undulating surface 902 spans substantially (e.g., equal to or greater than 90%) the dispensing member length 310 and surrounds the cylindrical shape of the paint dispensing member 304.

In some embodiments, at least one of the plurality of ridges 904*a-n* and at least one of the plurality of valleys 906*a-n* respectively have the at least one enclosed aperture 910*a-n* disposed thereon. The enclosed apertures 910*a-n* are disposed in an alternating configuration spanning the dispensing member length 310, wherein the alternating configuration is with respect to the at least one of the plurality of ridges 904*a-n* and the at least one of the plurality of valleys 906*a-n*. As a representative sample of the alternating configuration of the at least one enclosed aperture 910*a-n* on the at least one of the plurality of ridges 904*a-n* and the at least one of the plurality of valleys 906*a-n*, the placement of enclosed apertures 910*a*, 910*b* will be described herein. The enclosed aperture 910*a* is disposed on the valley 906*a* and the enclosed aperture 910*b* is disposed on the ridge 904*a*. In embodiments wherein a plurality of the plurality of ridges 904*a-n* and a plurality of the plurality of valleys 906*a-n* respectively have at least one enclosed aperture 910*a-n* disposed thereon, the enclosed apertures 910*a-n* are disposed in equally distant longitudinal configurations 926*a-n*, where "n" represents any number greater than one, spanning the dispensing member length 310.

In some embodiments, as shown in FIG. 11, the cantilevered mixing member 314 further comprises two flanges 1102, 1104 projecting radially in opposing directions from the cantilevered mixing member 314 along the mixing member length 320. The first and second flanges 1102, 1104 may include the same main features.

In a further embodiment, the two flanges 1102, 1104 are of a plate-like shape and substantially rigid material (e.g., plastic, metal, or any other substantially rigid material). Further each of the two flanges 1102, 1104 includes at least one enclosed aperture 1106*a-n*, where "n" represents any number greater than one, defined thereon. In some embodiments, each of the at least one enclosed aperture 1106*a-n* may be of an elongated shape. Further, each of the at least one enclosed aperture 1106*a-n* is operably configured to mix paint disposed within the paint mixing cavity 908 of the paint dispensing member 304 when the paint dispensing member 304 rotates at 360-degree rotations with respect to the roller body 112. Said another way, because the cantilevered member 314 is directly coupled on both the first end 316 and the second end 318 to the paint dispensing member 304 through the threaded coupling configuration and the recess 918 of the portion 916 and the paint dispensing member 304 is operably configured to rotate 360 degrees with respect to the roller body 112, the cantilevered mixing member 314 correspondingly moves with the paint dispensing member 304, thereby mixing the paint mixture (not shown) held within the enclosed paint mixing cavity 908.

In some embodiments, the cantilevered mixing member 314 may independently rotate within the paint mixing cavity 908 with respect to the paint dispensing member 304. In these embodiments, the recess 918 of the portion 916 on the inner side surface 914 of the inner surface 912 of the paint dispensing member 304 does not restrict the independent movement (i.e., the capability to rotate 360 degrees) of the second end 318 of the cantilevered mixing member 314 with respect to the paint dispensing member 304. Further, the closure member 1108 of the first end 316 of the cantilevered mixing member 314 may be disposed proximal to a swiveling panel 1304 (shown in FIG. 13). Further, a turntable bearing (not shown) is disposed between the closure member 1108 and the swivel panel 1304. As those of skill in the art may appreciate, the turntable bearing is operably configured to allow the swivel panel 1304 to independently rotate within the paint mixing cavity 908, independent of the paint dispensing member 304.

Referring back to FIG. 11, in embodiments wherein each of the two flanges 1102, 1104 include more than one enclosed aperture 1106*a-n* defined thereon, the enclosed apertures 1106*a-n* may be disposed in alternating arrangement with respect to one another on the two flanges 1102, 1104 spanning the mixing member length 320. As a representative sample of the alternating arrangement of the enclosed apertures 1106*a-n* with respect to one another on the mixing member length 320 of the two flanges 1102, 1104, the alternating arrangement of the enclosed apertures 1106*a*, 1106*b*, and 1106*n* will be described herein. The enclosed apertures 1106*a*, 1106*b* are disposed on the flange 1102 with a distance 1112 separating the enclosed apertures 1106*a*, 1106*b*. The enclosed aperture 1106*n* is disposed on the flange 1104 and lies, at least partially, within the distance 1112 separating the enclosed apertures 1106*a*, 1106*b* corresponding on the flange 1104.

Referring back to FIG. 9, in some embodiments, the plurality of ridges and valleys 904*a-n*, 906*a-n* are uniformly spaced spanning the dispensing member length 310.

In some embodiments, to ensure equal distribution of the paint mixture (not shown) housed in the paint mixing cavity 908 of the paint dispensing member 304 on a surface (not shown), at least approximately 40% of the at least one of the plurality of ridges 904*a-n* and the plurality of valleys 906*a-n* include the at least one enclosed aperture 910*a-n* defined thereon along the dispensing member length 310. The paint mixture may be any pigmented liquid, liquefiable, or mastic composition that, after application to a substrate in a thin layer, converts to a solid film. However, in preferred embodiments, at least approximately 50% of the at least one of the plurality of ridges 904*a-n* and the plurality of valleys 906*a-n* include the at least one enclosed aperture 910*a-n* defined thereon along the dispensing member length 310.

Figure 10:
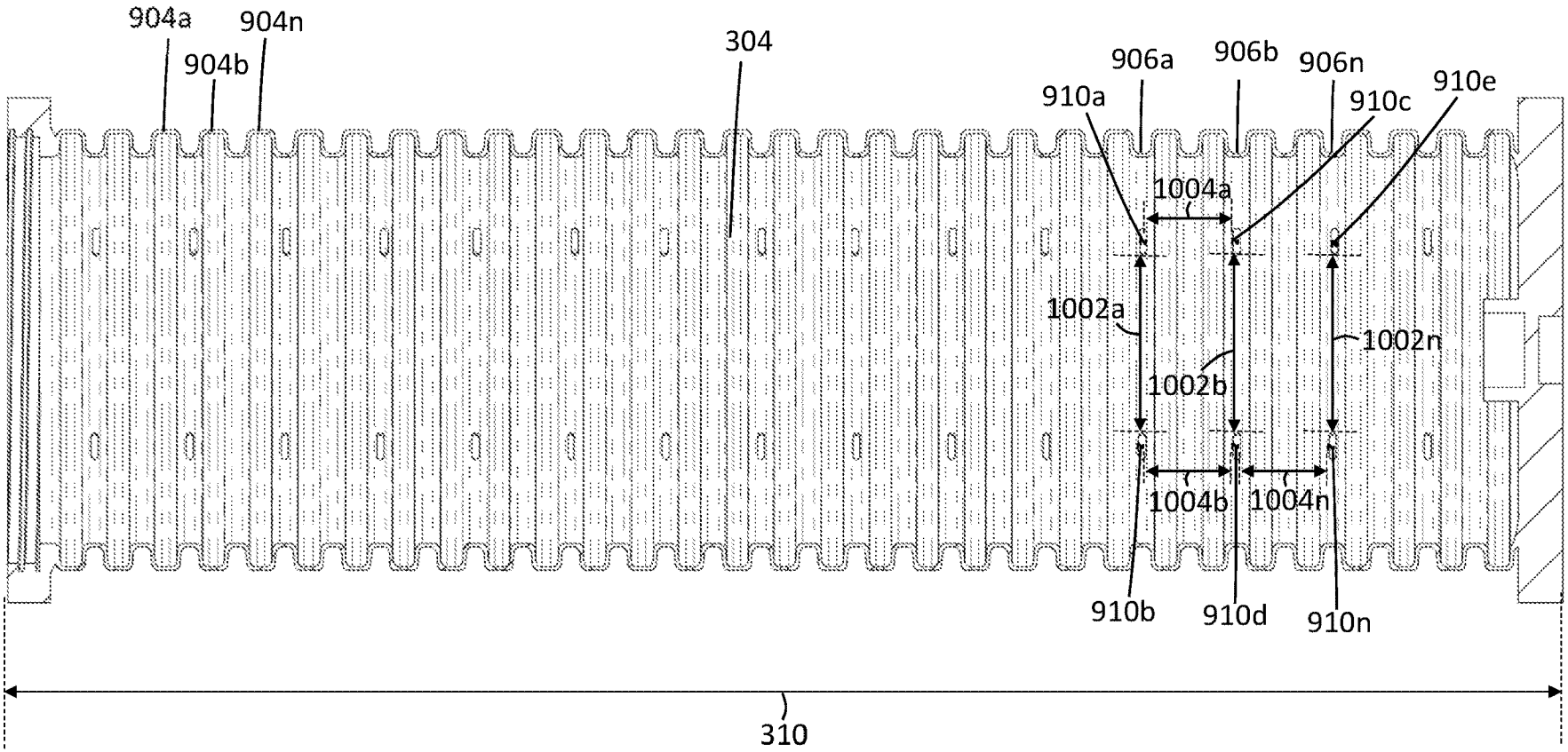
FIG. 10 is a cross sectional view of the paint dispensing member in FIG. 3 taken along section line B-B of FIG. 8.

Referring now to FIG. 10, in some embodiments, the plurality of at least one of the plurality of ridges 904*a-n* and the plurality of valleys 906*a-n* respectively have at least two enclosed apertures 910*a-n* defined and disposed at equally distant configurations 1002*a-n*, where "n" represents any number greater than one, around a circumference 704 (shown in FIG. 7) thereon. In the embodiment exemplified in FIG. 10, solely the plurality of the plurality of valleys 906*a-n* have at least two enclosed apertures 910*a-n* defined and disposed at equally distant configurations 1002*a-n*, where "n" represents any number greater than one, around the circumference 704 (shown in FIG. 7) thereon.

Further, in preferred embodiments, the at least two enclosed apertures 910*a-n* are disposed at equally distant longitudinal configurations 1004*a-n*, where "n" represents any number greater than one, spanning the dispensing member length 310.

As depicted in FIG. 4 and explained above, once the multiple parts comprising assembly 100 are assembled, the cantilevered mixing member 314 seats, at least partially, within the enclosed paint mixing cavity 908 (shown in FIG. 9) of the paint dispensing member 304. Further, the paint dispensing member 304 is disposed, at least partially, within the enclosed applicator member cavity 302 of the applicator member 102. Finally, the paint dispensing member 304, with the cantilevered mixing member 314 seated within, and the applicator member 102 are disposed proximal to the shell inner surface 122 and, at least partially, seated within the shell cavity 124 of the shell portion 116 of the roller body 112.

Figure 14:
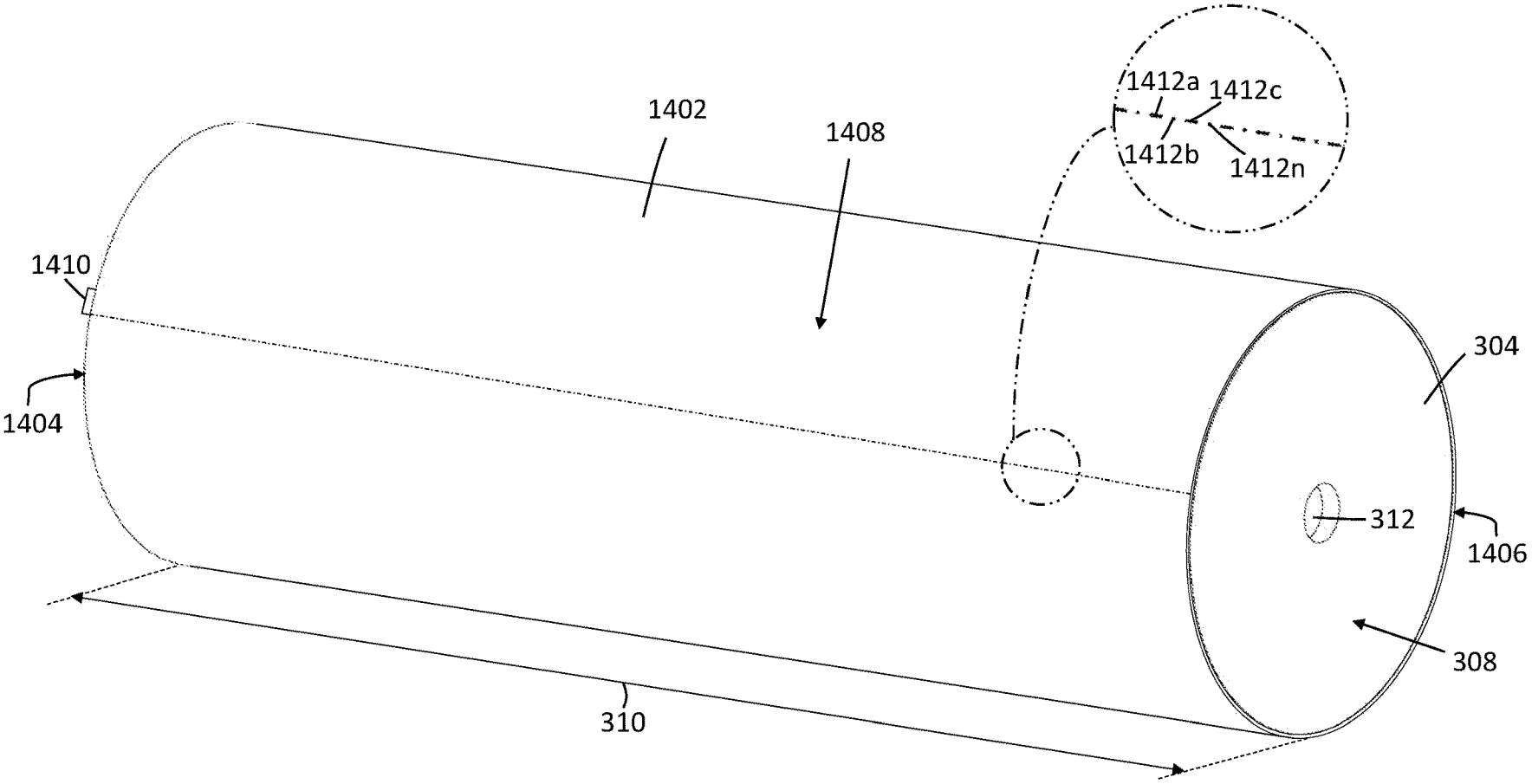
FIG. 14 is a perspective view of a paint assembly packaging in accordance with one embodiment of the present invention.

Referring now to FIG. 14, the assembly 100 may further comprise a paint assembly packaging 1402, of a polymeric material (e.g., acrylic, rubber, PVC, or any other polymeric material that is sufficient to cover the assembly 100), spanning the dispensing member length 310 and substantially enclosing (i.e., enclosed in a manner to prevent paint from escaping therefrom), in a hermetically sealed configuration (i.e., airtight), the applicator member 102 and the paint dispensing member 304, wherein the enclosed paint mixing cavity 908 houses paint mixture (not shown) therein. Said another way, due to the paint assembly packaging 1402 substantially enclosing the applicator member 102 and the paint dispensing member 304 in a hermetically sealed configuration, the paint assembly packaging 1402 is operably configured to seal in the paint mixture and maintain its original liquid-like consistency.

In a further embodiment, the paint assembly packaging 1402 further comprises a first end 1404, a second end 1406 opposing the first end 1404, an outer surface 1408, and an inner surface (not shown). The paint assembly packaging 1402 further includes a tab 1410 projecting outwardly away from at least one of the first end 1404 and the second end 1406 of the paint assembly packaging 1402. The tab 1410 is coupled to a plurality of readily severable indentations 1412*a-n*, where "n" represents any number greater than one, disposed on the outer surface 1408 of the paint assembly packaging 1402. The plurality of readily severable indentations 1412*a-n* substantially span the dispensing member length 310. The tab 1410 and the plurality of readily severable indentations 1412*a-n* are operably configured to facilitate the consumer's efforts in removing the packaging 1402 from the applicator member 102 and the paint dispensing member 304. It is important to note that the plurality of readily severable indentations 1412*a-n* do not create apertures to inhibit the hermetically sealed configuration of the packaging 1402. Said another way, the packaging 1402 remains in the hermetically sealed configuration although the outside surface 1408 includes the plurality of readily severable indentations 1412*a-n* substantially spanning the dispensing member length 310.

Figure 2:
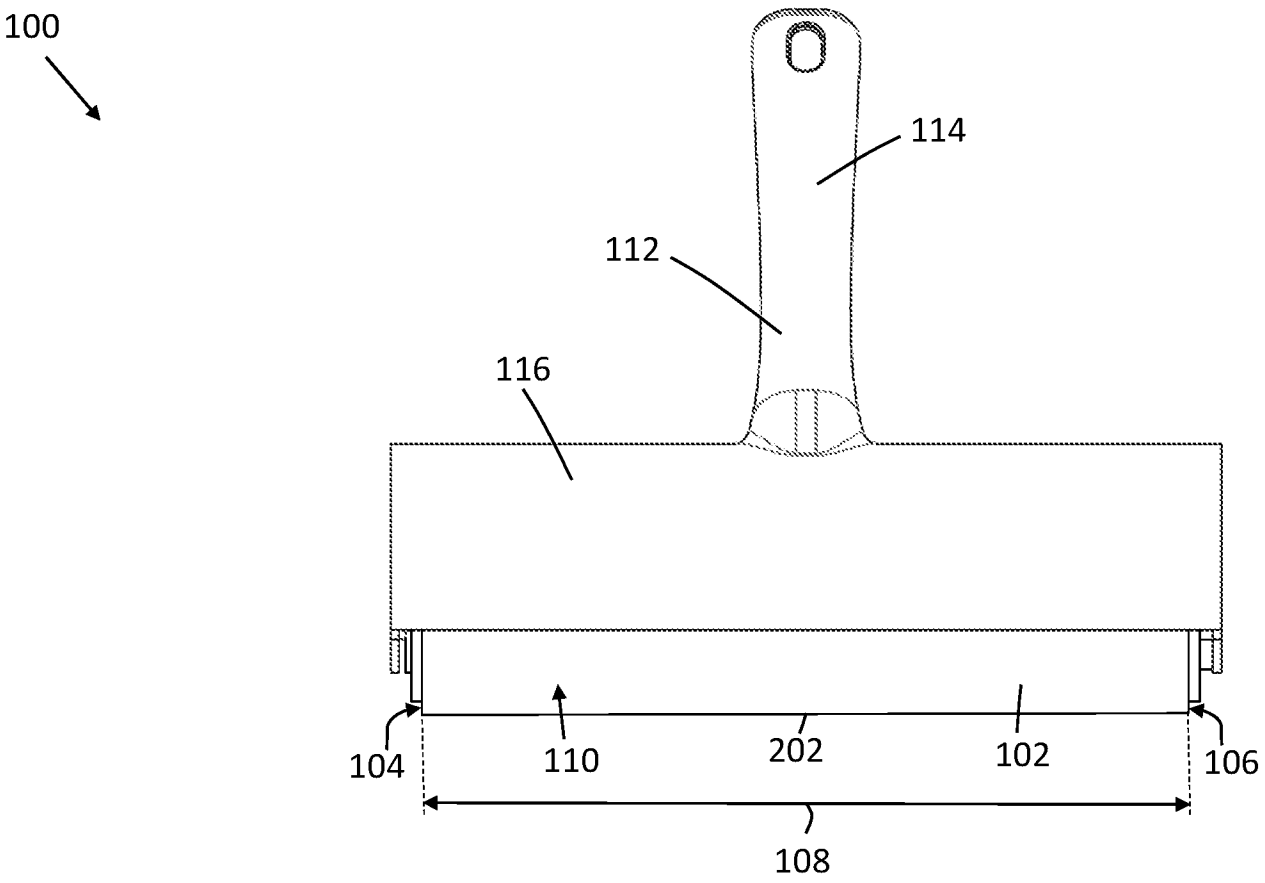
FIG. 2 is a top plan view of a paint dispensing roller assembly in accordance with one embodiment of the present invention.

In preferred embodiments, as shown in FIG. 2, the outer application surface 110 of the applicator member 102 has a uniform radius from a center 202 surrounding the cylindrical shape and spanning the applicator length 108 of the applicator member 102. Further, the applicator member 102 is of an absorbent material such as sponge, foam, lamb's wool, synthetic fabric or any other absorbent material that may be used to apply the paint mixture onto a surface (not shown).

In some embodiments, the surface 118 of the handle 114 may be of rubber, silicone or any other material sufficient for gripping.

It should be understood that terms such as, "front," "rear," "side," top," "bottom," and the like are indicated from the reference point of a viewer viewing the paint dispensing roller assembly 100 from the perspective shown in FIG. 2.

As such, a paint dispensing roller assembly has been disclosed that includes an applicator member of a cylindrical shape and an absorbent material defining an enclosed applicator member cavity. The paint dispensing roller assembly further includes a paint dispensing member of a cylindrical shape disposed within the applicator member cavity and having an outer undulating surface with a plurality of ridges and valleys, having at least one enclosed aperture defined thereon, wherein the paint dispensing member defines an enclosed paint mixing cavity. The paint dispensing roller assembly further includes a cantilevered mixing member disposed within the enclosed paint mixing cavity and having at least one flange projecting radially from the cantilevered mixing member. Finally, the paint dispensing roller assembly also includes a roller body including a handle and a shell portion, wherein the shell portion defines a shell cavity. The applicator member is partially disposed within the shell cavity and the applicator member and the paint dispensing member are operably configured to rotate 360 degrees with respect to the roller body.

What is claimed is:

1. A paint dispensing roller assembly comprising:

an applicator member of a cylindrical shape, of an absorbent material, having an applicator length separating two opposing ends of the applicator member, having an outer application surface surrounding the cylindrical shape of the applicator member and spanning the applicator length; and defining an enclosed applicator member cavity spanning the applicator length;

a paint dispensing member of a cylindrical shape, disposed at least partially within the enclosed applicator member cavity, having a first end, having a second end opposing the first end of the paint dispensing member, having a dispensing member length separating the first and second ends of the paint dispensing member, having an outer undulating surface spanning the dispensing member length and with a plurality of ridges and a plurality of valleys disposed in an alternating configuration with one another, and defining an enclosed paint mixing cavity, wherein at least approximately 40% of the plurality of ridges each having at least one enclosed aperture defined thereon and at least approximately 40% of the plurality of valleys each having at least one enclosed aperture defined thereon and in an alternating configuration with respect to the at least one enclosed aperture defined on the plurality of ridges;

a cantilevered mixing member disposed at least partially within the enclosed paint mixing cavity, having a first end, a second end opposing the first end of the cantilevered mixing member, a mixing member length separating the first and second ends of the cantilevered mixing member, and at least one flange projecting radially from the cantilevered mixing member along the mixing member length and encapsulated in the paint mixing cavity; and a roller body including a handle with a surface configured for grasping by a user and a shell portion having a shell inner surface defining a shell cavity with the cylindrical shape of the applicator member partially disposed therein, the applicator member and paint dispensing member operably configured to rotate 360 degrees with respect to the roller body.

2. The paint dispensing roller assembly according to claim 1, wherein:

the shell cavity is of a concave shape and shaped and sized to partially receive the cylindrical shape of the applicator member along the applicator length.

3. The paint dispensing roller assembly according to claim 1, wherein:

the second end of the cantilevered mixing member is free and the first end of the cantilevered mixing member is directly coupled to the shell inner surface through a male-female coupling configuration.

4. The paint dispensing roller assembly according to claim 3, wherein the shell inner surface further comprises:

a first side and a second side opposing the first side of the shell inner surface, the first side of the shell inner surface directly coupled to the first end of the cantilevered mixing member through the male-female coupling configuration and the second side of the shell inner surface directly coupled to the second end of the paint dispensing member through a male-female coupling configuration.

5. The paint dispensing roller assembly according to claim 3, wherein the paint dispensing member comprises:

an inner surface defining the enclosed paint mixing cavity and including an inner side surface disposed proximal to the second end of the paint dispensing member and including a portion shaped and sized to receive and partially enclose the second end of the cantilevered mixing member.

6. The paint dispensing roller assembly according to claim 5, wherein:

the portion on the inner side surface of the inner surface of the paint dispensing member is shaped and sized to frictionally retain the second end of the cantilevered mixing member, the second end of the cantilevered mixing member selectively removably coupled to the portion on the inner side surface of the inner surface of the paint dispensing member.

7. The paint dispensing roller assembly according to claim 1, wherein:

the first end of the paint dispensing member defines an enclosed first end opening and is operably configured to selectively removably couple to the first end of the cantilevered mixing member through a threaded coupling configuration.

8. The paint dispensing roller assembly according to claim 1, wherein:

the outer undulating surface spans substantially the dispensing member length and surrounds the cylindrical shape of the paint dispensing member.

9. The paint dispensing roller assembly according to claim 1, wherein the cantilevered mixing member further comprises:

two flanges projecting radially in opposing directions from the cantilevered mixing member along the mixing member length.

10. The paint dispensing roller assembly according to claim 9, wherein:

the two flanges are of a plate-like shape and substantially rigid material, each having at least one enclosed aperture defined thereon.

11. The paint dispensing roller assembly according to claim 1, wherein:

the plurality of ridges and the plurality of valleys are uniformly spaced spanning the dispensing member length.

12. The paint dispensing roller assembly according to claim 1, wherein:

the plurality of ridges and the plurality of valleys each respectively having at least two enclosed apertures defined thereon and disposed at equally distant configurations around a circumference thereon.

13. The paint dispensing roller assembly according to claim 1, further comprising:

a paint assembly packaging, of a polymeric material, spanning the dispensing member length and substantially enclosing, in a hermetically sealed configuration, the applicator member and the paint dispensing member, wherein the enclosed paint mixing cavity houses paint mixture therein.

14. The paint dispensing roller assembly according to claim 13, wherein the paint assembly packaging further comprises:

a first end, a second end opposing the first end, an outer surface, and an inner surface; and a tab:

projecting outwardly away from at least one of the first end and the second end of the paint assembly packaging; and coupled to a plurality of readily severable indentations disposed on the outer surface of the paint assembly packaging and substantially spanning the dispensing member length.

15. A paint dispensing roller assembly comprising:

an applicator member of a cylindrical shape, of an absorbent material, having an applicator length separating two opposing ends of the applicator member, having an outer application surface surrounding the cylindrical shape of the applicator member and spanning the applicator length; and defining an enclosed applicator member cavity spanning the applicator length;

a paint dispensing member of a cylindrical shape, disposed at least partially within the enclosed applicator member cavity, having a first end, a second end opposing the first end of the paint dispensing member, a dispensing member length separating the first and second ends of the paint dispensing member, defining an enclosed paint mixing cavity, and having an outer undulating surface spanning along the dispensing member length with a plurality of ridges and a plurality of valleys disposed in an alternating configuration with one another, wherein at least approximately 40% of the plurality of ridges each having at least one enclosed aperture defined thereon and at least approximately 40% of the plurality of valleys each having at least one enclosed aperture defined thereon and in an alternating configuration with respect to the at least one enclosed aperture defined on the plurality of ridges;

a cantilevered mixing member disposed at least partially within the enclosed paint mixing cavity, having a first end, a second end opposing the first end of the cantilevered mixing member, a mixing member length separating the first and second ends of the cantilevered mixing member, and at least one flange projecting radially from the cantilevered mixing member along the mixing member length and encapsulated in the paint mixing cavity;

a roller body including a handle with a surface configured for grasping by a user and a shell portion having a shell inner surface defining a shell cavity with the cylindrical shape of the applicator member partially disposed therein, the applicator member and paint dispensing member operably configured to rotate 360 degrees with respect to the roller body; and a paint assembly packaging, of a polymeric material, spanning the dispensing member length and substantially enclosing, in a hermetically sealed configuration, the applicator member and the paint dispensing member, wherein the enclosed paint mixing cavity houses paint mixture therein.

16. The paint dispensing roller assembly according to claim 15, wherein the paint assembly packaging further comprises:

a first end, a second end opposing the first end, an outer surface, and an inner surface; and a tab:

projecting outwardly away from at least one of the first end and the second end of the paint assembly packaging; and coupled to a plurality of readily severable indentations disposed on the outer surface of the paint assembly packaging and substantially spanning the dispensing member length.

* * * * *